US007051524B1

(12) United States Patent
Kraft

(10) Patent No.: US 7,051,524 B1
(45) Date of Patent: May 30, 2006

(54) VENTURI DEVICE

(76) Inventor: Bernard A Kraft, 38330 Maple Forest Blvd., Harrison Township, MI (US) 48045

( * ) Notice: Subject to any disclaimer, the term of this patent is extended or adjusted under 35 U.S.C. 154(b) by 198 days.

(21) Appl. No.: 10/610,377

(22) Filed: Jun. 30, 2003

(51) Int. Cl.
*F01N 7/00* (2006.01)

(52) U.S. Cl. ..... 60/324; 60/316

(58) Field of Classification Search ..... 60/316, 60/319, 324
See application file for complete search history.

(56) References Cited

U.S. PATENT DOCUMENTS 1,560,947 A 11/1925 Skelton
1,577,626 A 3/1926 Warth
1,638,087 A 4/1927 Clark
2,169,658 A 8/1939 Newton
3,347,147 A * 10/1967 Howard ..... 454/38
4,136,756 A 1/1979 Kawamura
4,143,731 A * 3/1979 Haustein ..... 180/89.2
4,313,523 A 2/1982 Copen
4,433,541 A 2/1984 Amano et al.
4,603,619 A * 8/1986 Amphoux ..... 454/33
4,778,029 A 10/1988 Thornburgh
4,970,859 A * 11/1990 Yates et al. ..... 60/324
5,431,013 A 7/1995 Yamaki et al.
5,738,184 A 4/1998 Masuda et al.
5,857,327 A 1/1999 Sato et al.
5,988,308 A * 11/1999 Qutub ..... 180/309
6,164,066 A 12/2000 Sakaguchi

* cited by examiner

*Primary Examiner*—Thomas Denion
*Assistant Examiner*—Diem Tran
(74) *Attorney, Agent, or Firm*—Michael I Kroll

(57) ABSTRACT

The present invention 10 discloses a venturi that is installed perpendicularly to the end of the exhaust pipe 12 of a truck or like vehicle 14 thus resulting in the air flow through the venturi being at a 90 degree angle relative to the exhaust gases exiting the exhaust pipe. The present invention 10 seeks to increase the performance and efficiency of an engine of a vehicle 14 by overcoming the backpressure in the engine exhaust system created by the muffler baffles. The present invention 10 may also be installed on automobiles and other motor vehicles 14 having appropriately modified exhaust systems. A front aperture 16 for air intake tapers in width to the back pressure relief port or nozzle 20 being slightly greater than the exhaust port 18 on the bottom portion thereof and then widens to form an air discharge port 22 on the rear portion thereof that is substantially wider and longer than the air intake port 16 thereby creating an air pressure differential wherein the reduced pressure in the back pressure relief port 20 serves to create a vortex to draw exhaust gases from the exhaust pipe 12 toward the discharge port 22.

9 Claims, 8 Drawing Sheets

VENTURI DEVICE

BACKGROUND OF THE INVENTION

1. Field of the Invention

The present invention relates generally to venturi devices and, more specifically, to an improved venturi having a front aperture for air intake which tapers in width to a size roughly equivalent to an exhaust intake port on the bottom portion thereof and then widens to form an air discharge port on the rear portion thereof that is substantially wider and longer than the air intake port thereby creating an air pressure differential wherein the reduced pressure in the exhaust port serves to create a vortex to draw exhaust gases from the exhaust pipe to achieve equilibrium.

2. Description of the Prior Art

There are other venturi devices designed for improving exhaust efficiency. Typical of these is U.S. Pat. No. 1,560,947 issued to D. M. Skelton on Nov. 10, 1925.

Another patent was issued to N. G. Warth on Mar. 23, 1926 as U.S. Pat. No. 1,577,626. Yet another U.S. Pat. No. 1,638,087 was issued to V. E. Clark on Aug. 9, 1927 and still yet another was issued on Aug. 15, 1939 to F. Newton as U.S. Pat. No. 2,169,658.

Another patent was issued to Y. Kawamura on Jan. 30, 1979 as U.S. Pat. No. 4,136,756. Yet another U.S. Pat. No. 4,313,523 was issued to Dennis E. Copen on Feb. 2, 1982. Another was issued to K. Amano, et al. on Feb. 28, 1984 as U.S. Pat. No. 4,433,541 and still yet another was issued on Oct. 18, 1988 to W. F. Thornburgh as U.S. Pat. No. 4,778,029.

Another patent was issued to Y. Yamaki on Jul. 11, 1995 as U.S. Pat. No. 5,431,013. Masuda, et al. was issued U.S. Pat. No. 5,738,184 on Jun. 11, 1996. Another was issued to S. Sato, et al., on Jan. 12, 1999 as U.S. Pat. No. 5,857,327. Y. Sakaguchi et al., was issued U.S. Pat. No. 6,164,066.

U.S. Pat. No. 1,560,947

Inventor: Dorothy M. Skelton

Issued: Nov. 10, 1925

In a muffler, the combination of a discharge pipe; a delivery pipe to deliver exhaust gases from the motor into said discharge pipe; a nozzle in said discharge pipe through which a flow of air is interspersed between the impulses of exhaust gases across the mouth of said nozzle; a check valve located centrally within said nozzle for preventing a reverse flow therethrough; and a collector to direct a flow of air through said nozzle; and a collector to direct a flow of air through said nozzle, said delivery pipe extending through a sleeve in said collector.

U.S. Pat. No. 1,577,626

Inventor: Nathaniel G. Warth

Issued: Mar. 23, 1926

A muffler for automotive gas engines including, in combination, an elongated cooling and muffling chamber having a longitudinal axis and an outlet at one end, an imperforate cylindrical engine exhaust pipe extended into the other end of said chamber axially thereof, a funnel air collector extending externally of the chamber for freely admitting atmospheric air into said chamber, said funnel having its discharge end tapered and extending into the muffling chamber substantially beyond the end of the engine exhaust pipe and spaced from and surrounding the discharge of said engine exhaust pipe whereby the hot exhaust gas as it discharges into said cooling and muffling chamber is met with a surrounding condensed flow of cooling air.

U.S. Pat. No. 1,628,087

Inventor: Virginius E. Clark

Issued: Aug. 9, 1927

In a silencer for an internal-combustion engine, an oval shaped elongated expansion chamber, a single exhaust pipe leading substantially tangentially into said chamber at approximately the longitudinal center of said oval, an air passage extending longitudinally through the central portion of said oval chamber, and a plurality of relatively small exhaust outlets leading from the expansion chamber into said air passage and distributed over a substantial area on both sides of said central exhaust inlet pipe.

U.S. Pat. No. 2,169,658

Inventor: Frank Newton

Issued: Aug. 15, 1939

A silencer comprising an enlarged tubular inner section open at both ends and adapted to be interposed in the exhaust line of an explosive engine and formed with a plurality apertures rearwardly extending deflectors overlong the apertures, an outer shell having a tapered rear portion sealed upon the exhaust line in rear of the inner tubular section, said tapered rear portion co acting with the exhaust pipe and inner tubular section in forming a gas trap, said shell having the front end portion flared outwardly and open to the atmosphere to scoop air into the space between the inner section and outer shell and into the gas trap, a plurality of longitudinally extending tubes disposed exteriorly of the outer shell and having their front end portion flared the rear ends of the tubes being open to the atmosphere, and rearwardly inclined branch pipes communicating with the tubes and with the gas trap, said tubes and branch pipes withdrawing gases from the gas trap by suction of air scooped into the flared ends of the tubes and passing across the discharge ends of the branch pipes.

U.S. Pat. No. 4,136,756

Inventor: Yoshio Kawamura

Issued: Jan. 30, 1979

A suction air muffler having a muffler case connected to the air cleaner, wherein a suction pipe connected at one end to the air inlet port formed in the muffler case extends through the muffler case. Air drawn by suction into the suction pipe passes through the muffler case before being delivered to the air cleaner so that the noise produced by the air drawn by suction into the suction pipe of a motorcycle can be minimized.

U.S. Pat. No. 4,313,523

Inventor: Dennis E. Copen

Issued: Feb. 2, 1982

A method and apparatus are provided for reducing back pressure within an exhaust system for an internal combustion engine by creating a venturi within the exhaust system and forcing air through the venturi to create suction for drawing exhaust gases away from the exhaust system. The exhaust system of a conventional automobile is modified by coupling one end of an air directing pipe to the tailpipe of the automobile near the outlet of the tailpipe and at an acute angle thereto for creating a venturi. Air is forced into the opposite end of the air directing pipe by an air scoop or a fan, and the forced air is directed through the outlet of the tailpipe for providing suction which draws exhaust gases out of the tailpipe.

U.S. Pat. No. 4,433,541

Inventor: Katsuhisa Amano et al.

Issued: Feb. 28, 1984

A secondary air introducing apparatus for introducing secondary air into the exhaust manifold of an internal combustion engine is disclosed. The apparatus includes a secondary air introducing passage connected between the air cleaner and the exhaust manifold of the engine, a check valve in the passage arranged to operate in response to pulsation pressure in the exhaust manifold to supply clean secondary air thereto, a first expansion chamber interposed in the passage on an upstream side of the check valve, and a second expansion chamber interposed in the passage on an upstream side of the first chamber. At least the check valve and the first chamber are fixedly mounted on the intake manifold.

U.S. Pat. No. 4,778,029

Inventor: William F. Thornburgh

Issued: Oct. 18, 1988

A noise attenuating tube mounted in an engine compartment air intake hood duct of a motor vehicle to attenuate engine air intake noise in the hood is disclosed.

U.S. Pat. No. 5,431,013

Inventor: Yasuhito Yamaki, et al.

Issued: Jul. 11, 1995

An engine exhaust apparatus comprises a sound suppressing section for lowering the exhaust noise level as an exhaust gas discharged from the exhaust port passes through it. The exhaust apparatus is provided with an ejector section for introducing secondary air into the exhaust gas delivered from the sound suppressing section and mixing the gases, and a post-treatment section for purifying the gas mixture delivered from the ejector section. The exhaust gas discharged from an exhaust manifold gets into the ejector section through the sound suppressing section, and is then purified in the post-treatment section. Therefore, the ejector effect cannot be reduced by the sound suppressing section which is subject to high flow resistance. Thus, the exhaust noise level can be lowered with the ejector effect of the introduction of the secondary air improved considerably, and low cost and simple construction can be enjoyed.

U.S. Pat. No. 5,738,184

Inventor: Isao Masuda, et al.

Issued: Apr. 14, 1998

A muffler for a two-stroke internal combustion engine has an expansion chamber into which a rush of exhaust gas is introduced from the engine. In the vicinity of an exhaust gas inlet from the engine into the expansion chamber, the muffler has an external air intake for external air to be suctionally introduced into the expansion chamber by the rush of exhaust gas. With the external air introduced, carbon monoxide (CO) emission into the ambient is reduced.

U.S. Pat. No. 5,857,327

Inventor: Shigeru Sato, et al.

Issued: Jan. 12, 1999

A muffler for an internal combustion engine has an expansion chamber (31, 32) into which exhaust gas from the engine is introduced. The expansion chamber has a double wall (32A), with an inner panel (42) of the double wall (32A) having exhaust gas discharge portions (42A, 42B, 42C, 42D) with respective blowout holes (61, 62, 63, 64) for introducing the exhaust gas from the expansion chamber (32) into an air space (Sb) in the double wall (32A). From the air space (Sb), the exhaust gas is vented to the ambient through a discharge hole (37A) in an outer panel (42) of the double wall (32A). A spark arrester screen (72) covers the discharge hole (37A).

U.S. Pat. No. 6,164,066

Inventor: Yukio Sakaguchi, et al.

Issued: Dec. 26, 2000

A muffler for an internal combustion engine has a vertically elongated expansion chamber into which an exhaust gas from the exhaust port of internal combustion engine is introduced. The expansion chamber is separated level-wise into a first expansion chamber and a second expansion chamber by a partition plate. An exhaust emission purifier formed of an oxidation catalyst is attached to the partition plate, thereby allowing the exhaust gas ejected from the exhaust port to be introduced into the second expansion chamber from the first expansion chamber via the exhaust emission purifier. The exhaust emission purifier is spaced apart from the exhaust port by a predetermined distance in a direction orthogonal to an ejecting direction of the exhaust gas.

While these venturi devices may be suitable for the purposes for which they were designed, they would not be as suitable for the purposes of the present invention, as hereinafter described.

SUMMARY OF THE PRESENT INVENTION

The present invention discloses a venturi that is installed perpendicularly to the end of the exhaust pipe of a truck or like vehicle thus resulting in the air flow through the venturi being at a 90 degree angle relative to the exhaust gases exiting the exhaust pipe. The present invention seeks to increase the performance and efficiency of an engine of a vehicle by overcoming the backpressure in the engine exhaust system created by the muffler baffles. The present invention may also be installed on automobiles and other motor vehicles having appropriately modified exhaust systems. A front aperture for air intake tapers in width to the back pressure relief port or nozzle being a size slightly greater than the exhaust port on the bottom portion thereof and then widens to form an air discharge port on the rear portion thereof that is substantially wider and longer than the air intake port thereby creating an air pressure differential wherein the reduced pressure in the back pressure relief port serves to create a vortex to draw exhaust gases from the exhaust pipe to the rear discharge port.

A primary object of the present invention is to provide a device that will reduce backpressure in the exhaust system of diesel engines in trucks.

Another object of the present invention is to provide an improved venturi that will create a vacuum to evacuate exhaust from the exhaust pipe in a more effective manner.

Yet another object of the present invention is to provide an improved venturi that will increase fuel efficiency in any automotive application with diesel or gasoline powered engines.

Still yet another object of the present invention is to provide an improved venturi that will reduce backpressure in the exhaust system resulting in the improvement of engine performance.

Still yet another object of the present invention is to provide an improved venturi that is simple and easy to use.

One other object of the present invention is to provide an improved venturi that is inexpensive to manufacture and operate.

Additional objects of the present invention will appear as the description proceeds.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
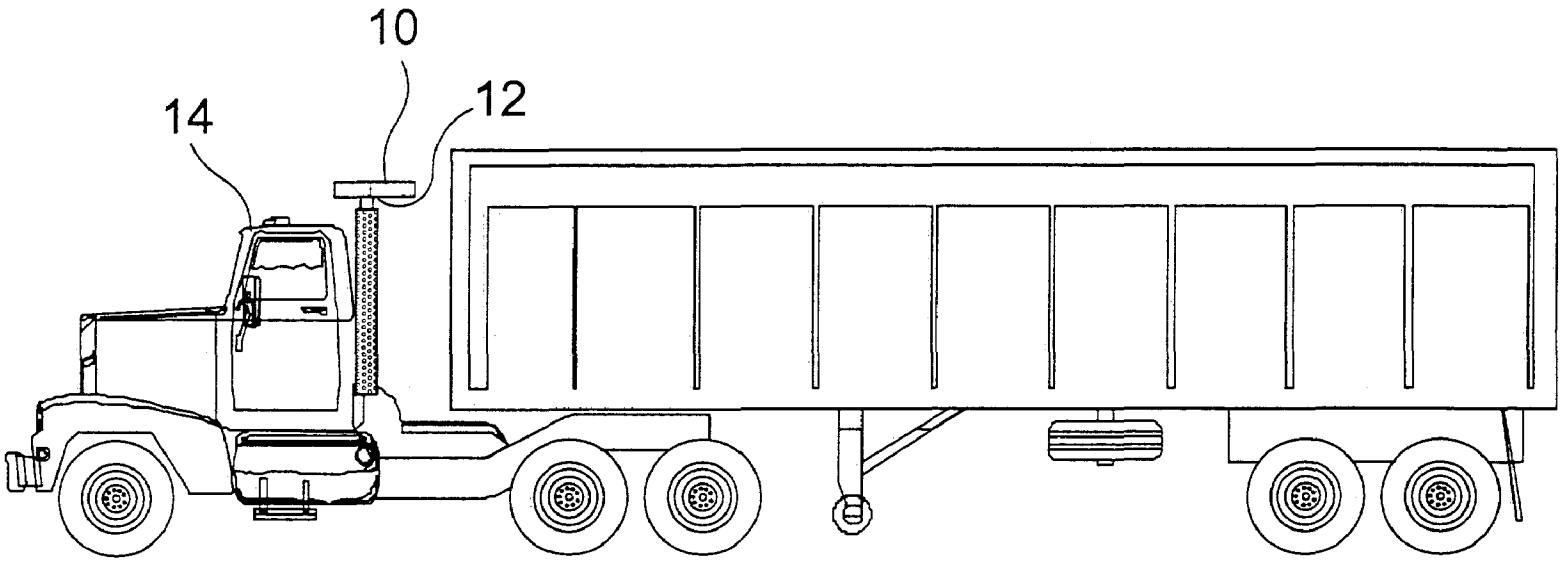
FIG. 1 is a side view of the present invention in use.

With regard to reference numerals used, the following numbering is used throughout the drawings.

10 present invention
12 exhaust pipe
14 vehicle
16 air intake port
18 exhaust port
20 back pressure relief port/nozzle
22 air discharge port
24 muffler
26 flange
28 vortex
30 exhaust gas
32 suction
34 arrows
36 high pressure
38 low pressure
40 anchor reinforcement
42 air diverting device
44 cab

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is a side view of the present invention 10 in use. The present invention 10 discloses a venturi that is installed perpendicularly to the end of the exhaust pipe 12 of a truck or like vehicle 14 thus resulting in the air flow through the venturi being at a 90 degree angle relative to the exhaust gases exiting the exhaust pipe. The present invention 10 seeks to increase the performance and efficiency of an engine of a vehicle 14 by overcoming the backpressure in the engine exhaust system created by the muffler baffles. The present invention 10 may also be installed on automobiles and other motor vehicles 14 having appropriately modified exhaust systems.

Figure 2:
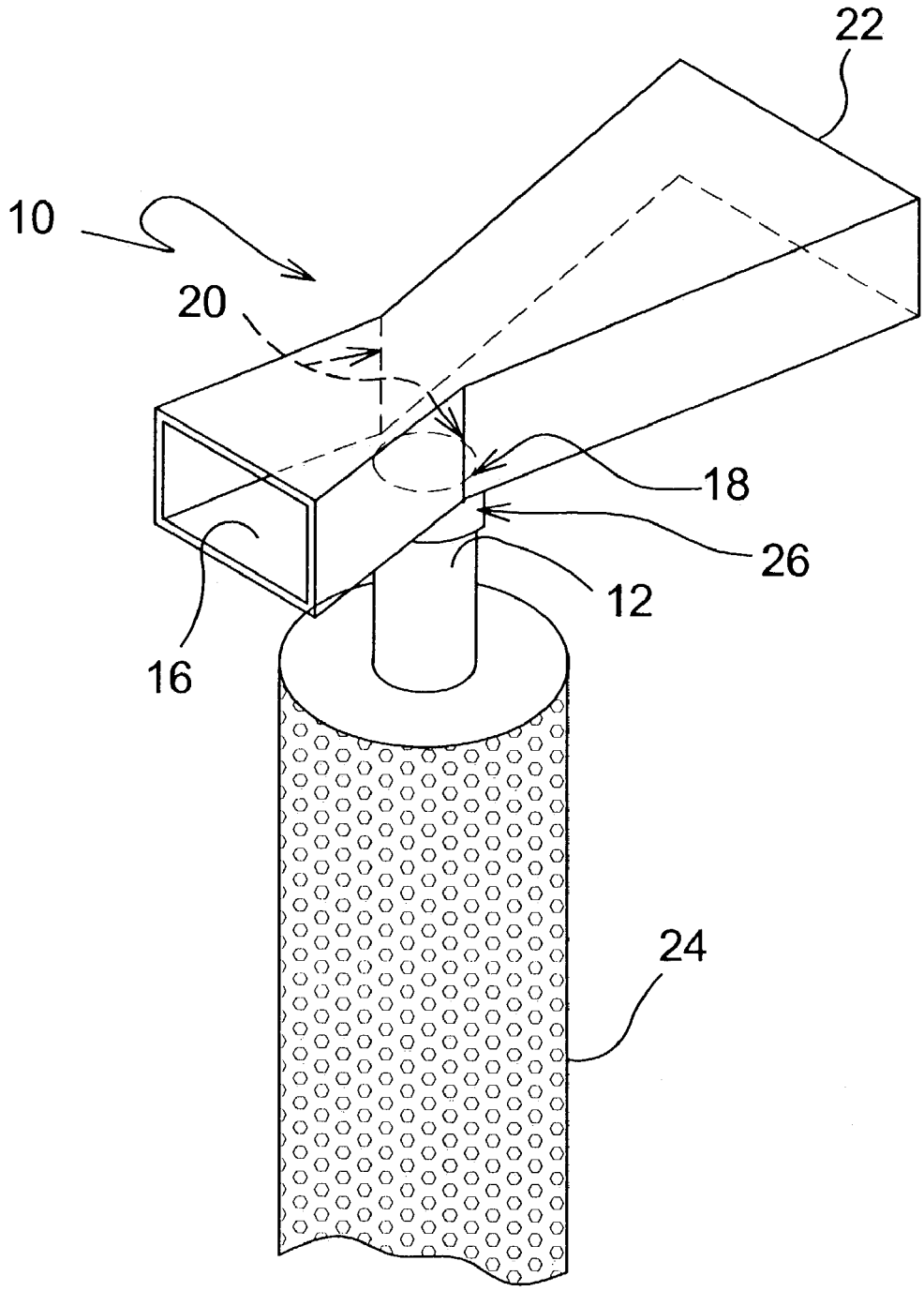
FIG. 2 is a perspective view of the present invention.

Turning to FIG. 2, shown therein is a perspective view of the present invention 10. The present invention 10 is easy to install on trucks having a vertical exhaust pipe 12 on muffler 24 (as opposed to the modifications to the exhaust system that are required with passenger cars and other motor vehicles) and has no moving parts to wear down and break. The present invention 10 has a front aperture 16 for air intake which tapers in width to the back pressure relief port or nozzle 20 being slightly larger than the exhaust port on the bottom portion thereof and then widens to form an air discharge port 22 on the rear portion thereof that is substantially wider and longer than the air intake port 16 thereby creating an air pressure differential wherein the reduced pressure in the back pressure relief port 20 serves to create a vortex to draw exhaust gases from the exhaust pipe 12 to achieve improved gas exhaust flow. Flange 26 is shown for attaching the present invention 10 to exhaust pipe 12.

Figure 3:
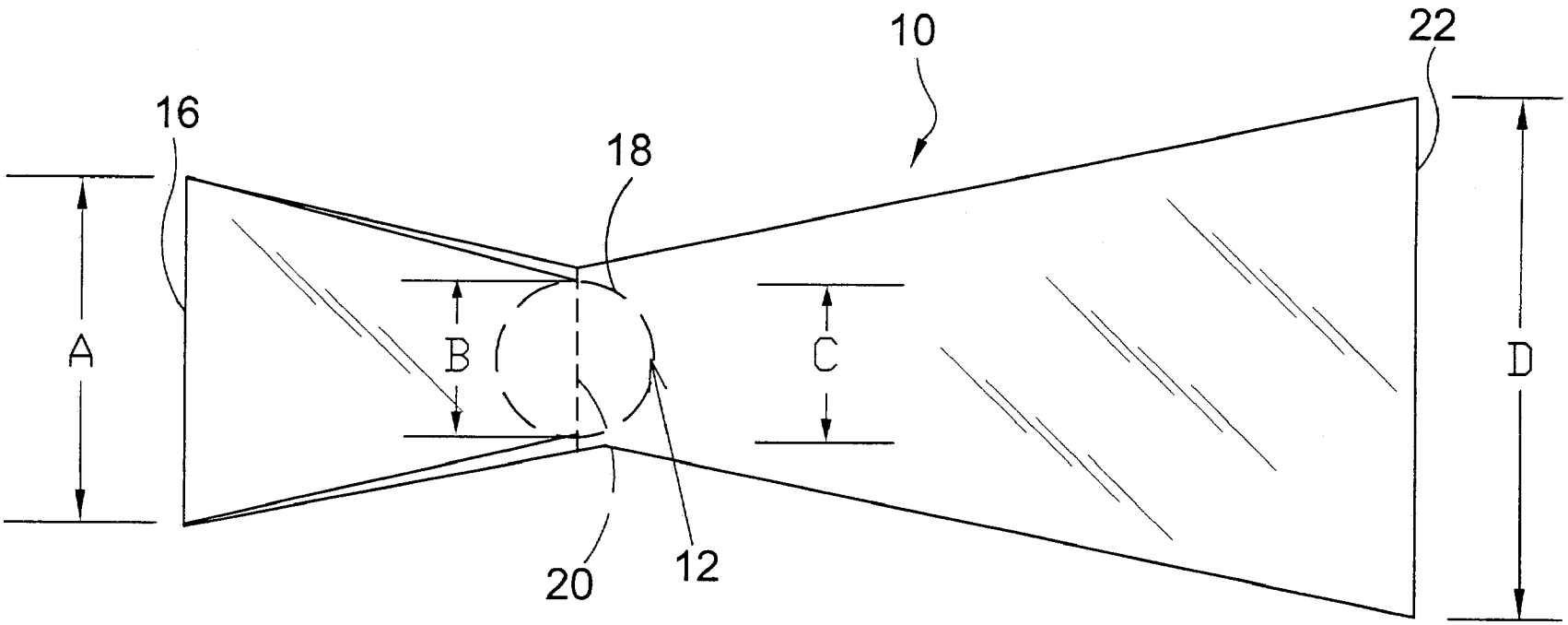
FIG. 3 is a top view of the present invention.

Turning to FIG. 3, shown therein is a top view of the present invention 10. Shown is a top view of the venturi of the present invention 10 having an intake port 16 dimension "A" of a predetermined size greater than the square area of the outlet opening of the exhaust pipe 18 dimension "C" and less than the square area of the aperture of the discharge port 22 dimension "D". The intake port 16 decreases in size to a nozzle-like back pressure relief port opening 20 dimension "B" just prior to encountering and overlapping the exhaust pipe opening 18 thus creating a vacuum over the outlet opening of the exhaust pipe port 18 which draws the exhaust gases from the exhaust system to the venturi discharge port 22.

Figure 4:
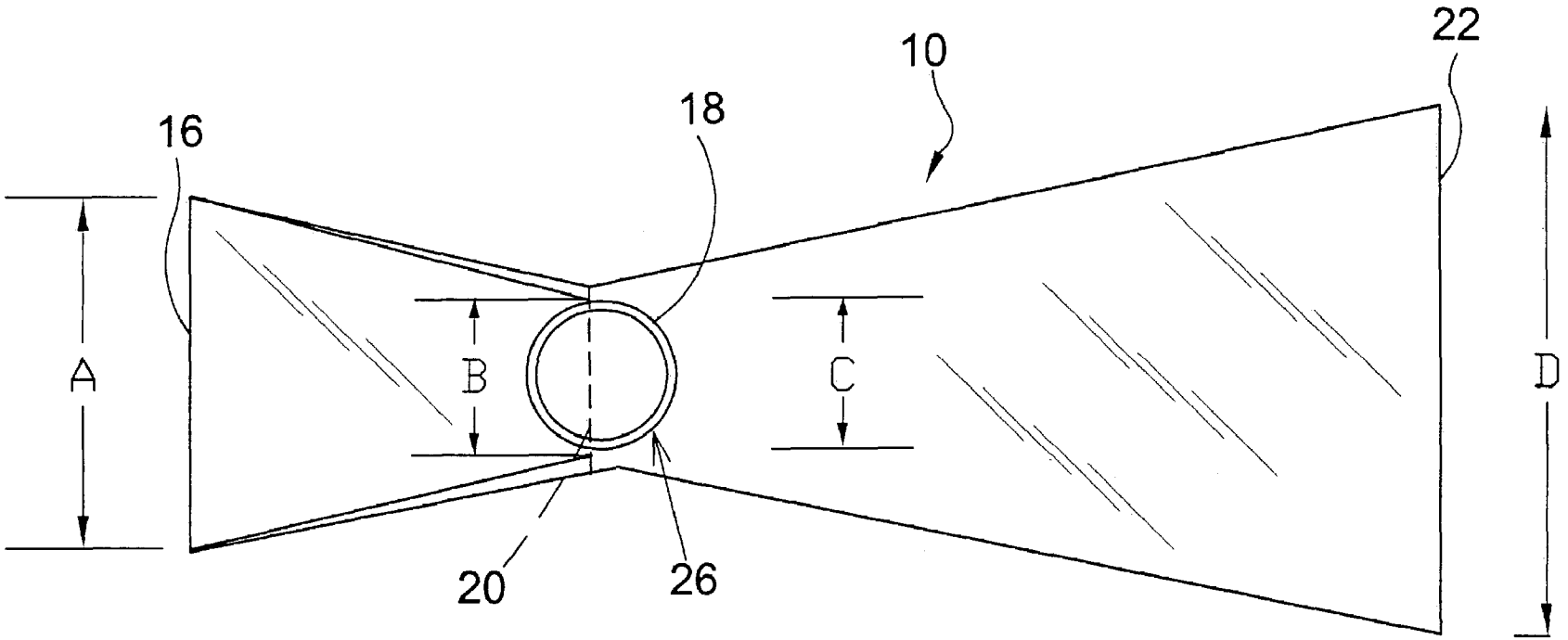
FIG. 4 is a bottom view of the present invention.

Turning to FIG. 4, shown therein is a bottom view of the present invention 10. Shown is a bottom view of the venturi of the present invention 10 having an intake port 16 of a predetermined size greater than the square area of the outlet opening of the exhaust pipe 18 and less than the square area of the aperture of the discharge port 22. The intake port 16 dimension "A" decreases in size to a nozzle-like port 20 dimension "B" opening prior to encountering the exhaust pipe opening 18 dimension "C" thus creating a vacuum over the outlet opening of the exhaust pipe 18 which draws the exhaust gases from the exhaust system to the venturi discharge port 22 dimension "D". The venturi 10 has a downwardly extending pipe flange 26 having an interior dimension substantially equal to the exterior dimension of the exhaust pipe 18 whereby the flange being of sufficient length frictionally engages the top portion of exhaust pipe 18. The flange 26 could also be mounted by other means well known within the art, such as by being welded.

Figure 5:
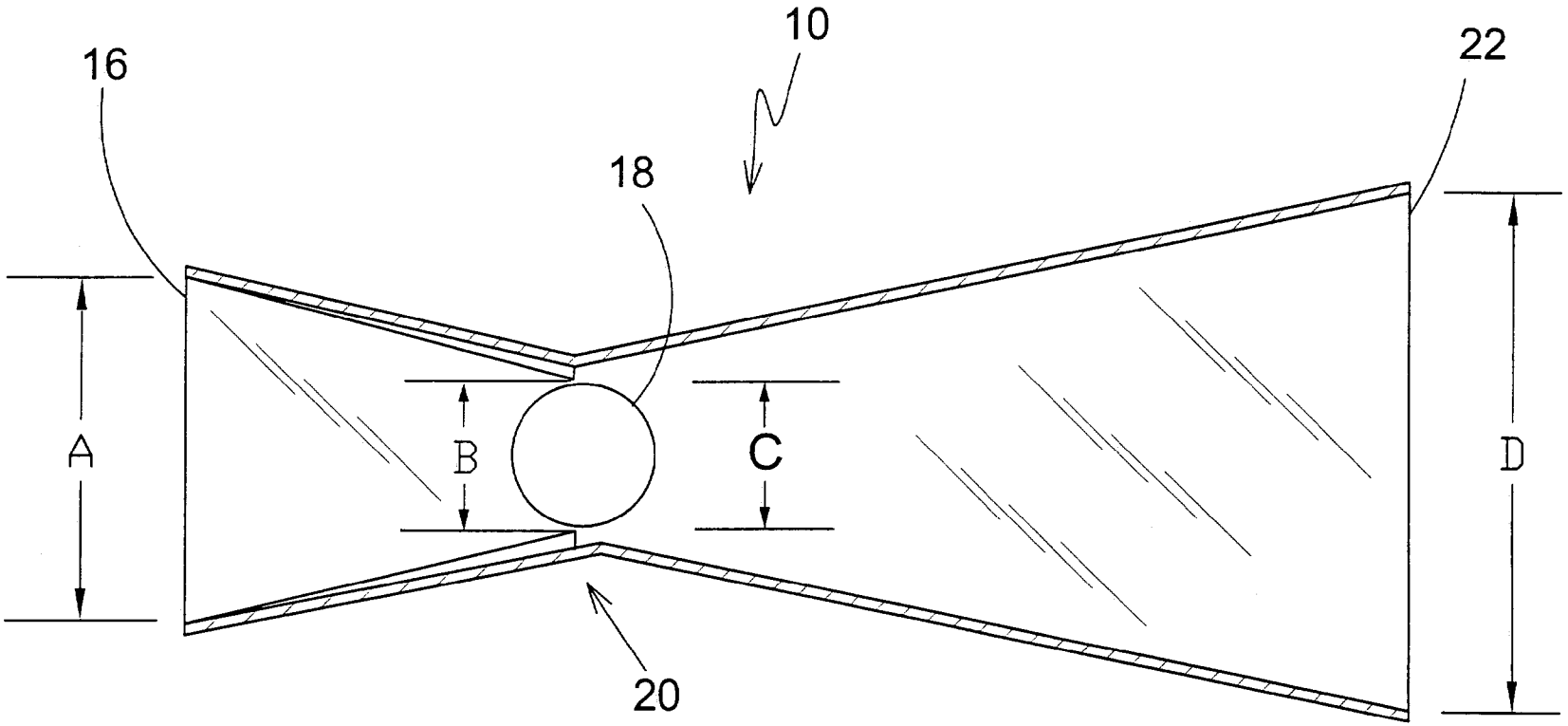
FIG. 5 is a bottom sectional view of the present invention.

Turning to FIG. 5, shown therein is a bottom sectional view of the present invention 10. Shown is a bottom view of the venturi of the present invention 10 having an intake port 16 of a calculated size greater than the outlet opening of the exhaust pipe 18 and less than the opening of the discharge port 22. The intake port 16 dimension "A" decreases in size to a nozzle-like port opening 20 dimension "B" prior to encountering the exhaust pipe opening 18 dimension "C" where a vacuum is created by the acceleration of the air flow due to the enlarged aperture 22 at the large end. The vacuum over the outlet opening of the exhaust pipe 18 draws the exhaust gases from the exhaust system to the venturi discharge port 22 dimension "D". The actual dimension of the intake port 16 dimension "A" and discharge port 22 dimension "D" are determined by the dimensions of the exhaust pipe opening 18 dimension "C". If the diameter of the exhaust pipe 18 is "X", then dimension "A" would be about 2× and dimension "D" would be about 3×.

Figure 6:
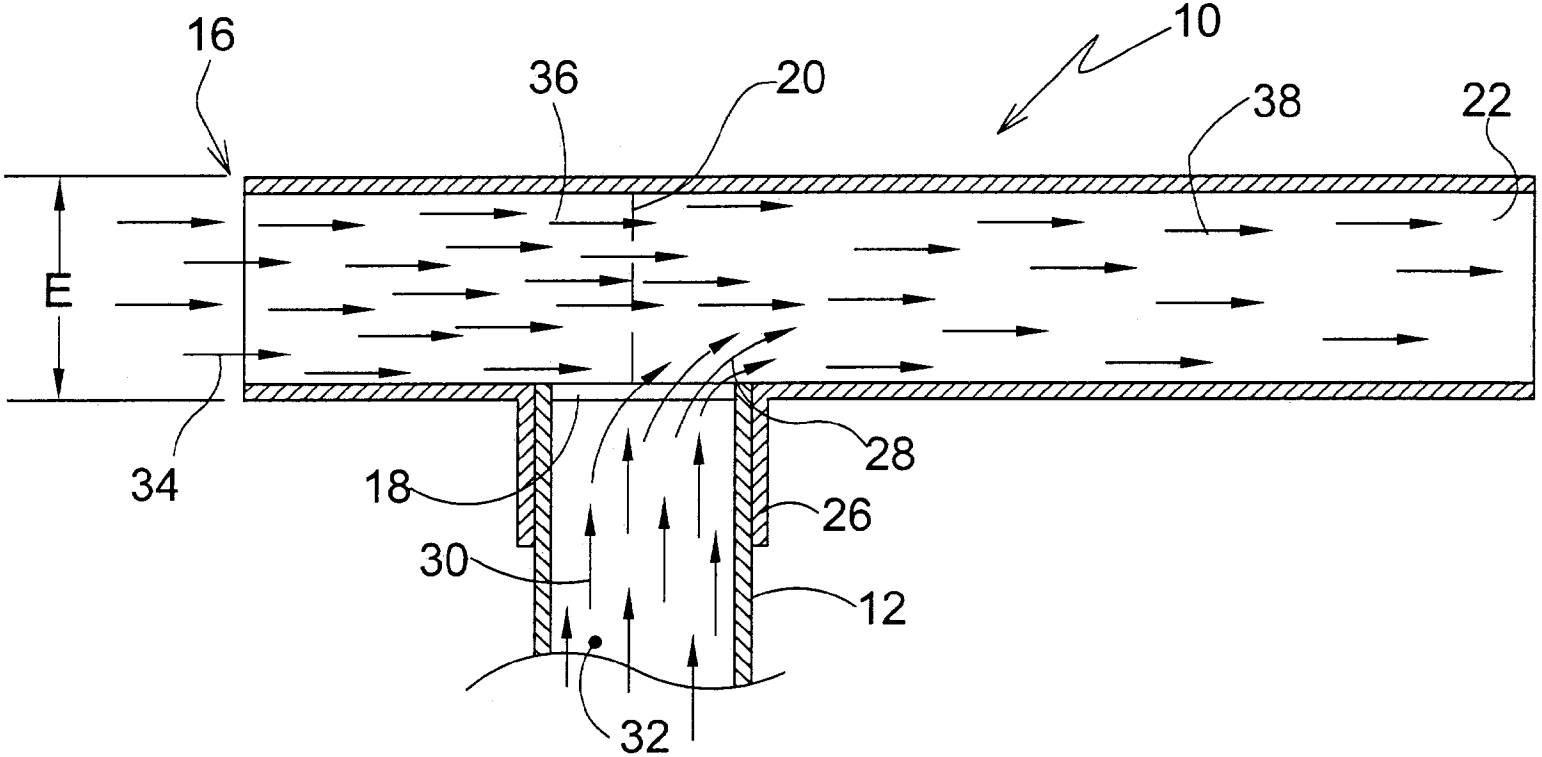
FIG. 6 is a side view of the present invention in use.

Turning to FIG. 6, shown therein is a side view of the present invention 10 in use. Air shown by arrows 34 is forced into the intake port 16 due to the forward motion of the vehicle and is compressed as it travels through the narrowing intake port 16 and through the nozzle 20 and into the exhaust port 18 area where the widening walls create a pressure differential wherein the reduced pressure in the exhaust port 18 area serves to create a vortex 28 causing suction at 32 to draw exhaust gases at 30 from the exhaust pipe 12 in an effort by the exhaust gases to achieve pressure equilibrium. Also shown is the dimension "E" which may be the same dimension as the exhaust pipe 12. Thus, the air intake 16, the back pressure relief nozzle 20 and the outlet 22 are substantially the same height. Also shown are areas of high 36 and low 38 pressure and flange 26.

Figure 7:
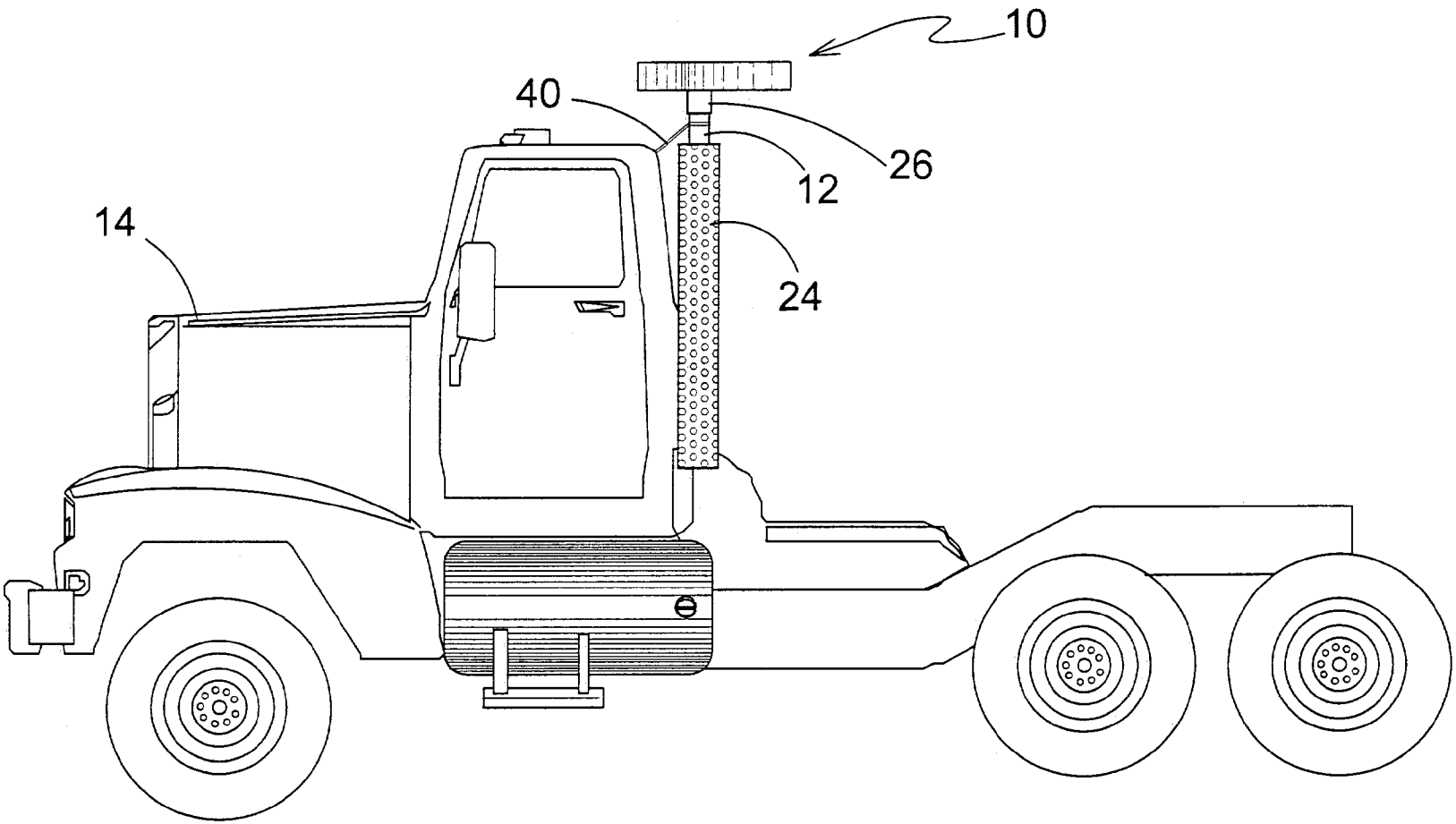
FIG. 7 is an additional element of the present invention.

Turning to FIG. 7, shown therein is an additional element of the present invention 10. Shown is an additional element of the present invention 10 comprising an anchor reinforcement 40 for the exhaust system to accommodate those systems that would require additional support for the exhaust system to compensate for the additional lateral pressure caused by the venturi. Also shown are flange 26, exhaust pipe 12 and muffler 24 on vehicle 14.

Figure 8:
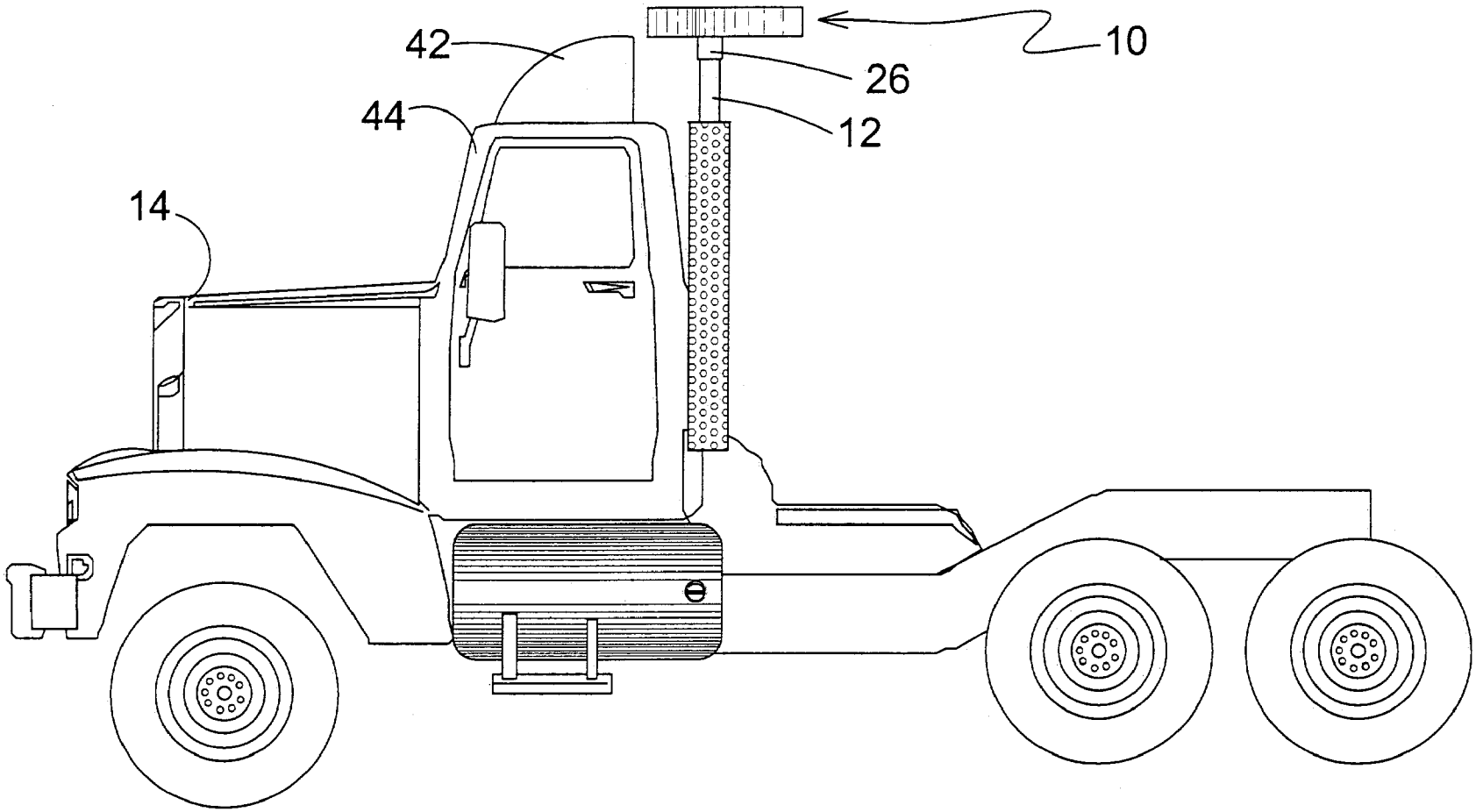
FIG. 8 is another additional element of the present invention.

Turning to FIG. 8, shown therein is another additional element of the present invention 10. Shown is another additional element of the present invention 10 for those cabs having an air-diverting device 42 mounted on the cab 44 of vehicle 14. The present invention 10 is positioned above the air diverting device 42 to receive maximum airflow. Also shown are flange 26 and exhaust pipe 12.

I claim:

1. A venturi for attachment to an exhaust system of a vehicle, comprising:

a) a cylindrical exhaust pipe disposed on the vehicle, said exhaust pipe having a circular outlet, wherein said exhaust pipe is substantially vertically disposed and said outlet is at an upper end of said exhaust pipe;

b) a venturi disposed on said outlet of said exhaust pipe whereby the venturi increases the outward flow of gases from the exhaust pipe;

c) means for attaching said venturi to the outlet of the exhaust pipe whereby the venturi is substantially horizontally secured to the exhaust pipe;

d) said venturi having flat top and bottom surfaces, and oppositely facing rectangular shaped sides bent in midsections to form a converging air inlet section terminating in a throat section, and an expanding air discharge section, said converging inlet section facing a front of said vehicle and said expanding discharge section facing a rear of said vehicle, and said venturi having an exhaust opening in the bottom surface of said throat section corresponding with said outlet of said exhaust pipe, said exhaust opening having an area greater than the area of said exhaust pipe outlet; and e) said expanding discharge section having a discharge opening whose area is greater than an area of an entrance into said converging air inlet section.

2. The venturi of claim 1, wherein said means for attaching said venturi, comprises:

a downwardly extending pipe flange disposed on said bottom of said venturi, wherein said pipe flange connects the exhaust opening of said venturi to said outlet of said exhaust pipe to permit exhaust gases to flow through the venturi.

3. The venturi of claim 2, wherein a center of said exhaust opening is disposed in said throat section between said air inlet section and said air discharge section to permit exhaust gases to flow out the air discharge section outlet.

4. The venturi of claim 3, wherein said air entrance has an area greater than the area of said outlet of said exhaust pipe.

5. The venturi of claim 4, wherein said throat section has a width slightly greater than the diameter of said exhaust opening.

6. The venturi of claim 5, wherein said discharge opening has a width about three times greater than the diameter of said exhaust opening.

7. The venturi of claim 6, wherein said entrance into said converging air inlet section has a width about two times greater than the diameter of said exhaust opening.

8. The venturi of claim 7, wherein the vehicle has a cab thereon, said cab having a roof thereon, said roof having an air diverter thereon, wherein said venturi is disposed above said air diverter to permit air to flow into the venturi.

9. The venturi of claim 8, further comprising an anchor reinforcement connecting said venturi to said cab of the vehicle to permit the venturi to be secured to the vehicle.

* * * * *